US005651877A

United States Patent [19]

Gould et al.

[11] Patent Number: 5,651,877

[45] Date of Patent: Jul. 29, 1997

[54] LUBRICATING OIL DEWAXING WITH MEMBRANE SEPARATION

[75] Inventors: Ronald M. Gould, Sewell, N.J.; Harold A. Kloczewski, Pasadena; Krishna S. Menon, Ellicott City, both of Md.; Thomas E. Sulpizio, Lompoc, Calif.; Lloyd S. White, Columbia, Md.

[73] Assignee: Mobil Oil Corporation, Fairfax, Va.

[21] Appl. No.: 633,265

[22] Filed: Apr. 16, 1996

[51] Int. Cl.[6] ..... C10G 73/06

[52] U.S. Cl. ..... 208/33; 208/37; 208/38; 208/31; 210/500.39; 210/654; 585/819

[58] Field of Search ..... 208/38, 33, 31; 210/500.39, 654; 585/819

[56] References Cited

U.S. PATENT DOCUMENTS

| | | | |
|---|---|---|---|
| 4,206,034 | 6/1980 | Broadhurst | 208/38 |
| 4,532,041 | 7/1985 | Shuey et al. | 585/818 |
| 5,067,970 | 11/1991 | Wang et al. | 55/16 |
| 5,084,183 | 1/1992 | Lafreniere et al. | 208/28 |
| 5,264,166 | 11/1993 | White et al. | 264/41 |
| 5,358,625 | 10/1994 | Gould et al. | 208/38 |
| 5,360,530 | 11/1994 | Gould et al. | 208/31 |
| 5,401,383 | 3/1995 | Ewener | 208/33 |
| 5,494,566 | 2/1996 | Gould et al. | 208/33 |

*Primary Examiner*—Helane Myers

*Attorney, Agent, or Firm*—Malcolm D. Keen; Thomas W. Steinberg

[57] ABSTRACT

A semicontinuous process for solvent dewaxing a waxy petroleum oil feed stream including the steps of: diluting of the waxy oil feed stream with solvent; feeding cold oil/solvent/wax mixture to a filter to remove the wax and obtain an oil/solvent filtrate stream; contacting the oil/solvent filtrate stream with a selective semipermeable membrane to selectively transfer solvent through the membrane to obtain a solvent-rich permeate; and periodically directing a warm stream of recovered solvent onto the membrane surface to wash the membrane and remove impurities therefrom.

15 Claims, 4 Drawing Sheets

LUBRICATING OIL DEWAXING WITH MEMBRANE SEPARATION

FIELD OF THE INVENTION

The present invention is directed to a process for dewaxing waxy oil feeds. This invention is particularly directed to a process for solvent dewaxing waxy petroleum oil fractions and membrane separation of filtered solvent-oil mixtures.

BACKGROUND OF THE INVENTION

Typical solvent dewaxing processes mix waxy oil feed with solvent from a solvent recovery system. The waxy oil feed/solvent mixture is cooled by heat exchange and filtered to recover solid wax particles. A filtrate comprising a mixture of oil and solvent is recovered from the filtration step. At present, dewaxing of waxy feed is performed by mixing the feed with a solvent to completely dissolve the waxy feed at a suitable elevated temperature. The mixture is gradually cooled to an appropriate temperature required for the precipitation of the wax and the wax is separated on a rotary filter drum. The dewaxed oil is obtained by evaporation of the solvent and is useful as a lubricating oil of low pour point.

This type of dewaxing apparatus is expensive and complicated. In many instances the filtration proceeds slowly and represents a bottleneck in the process because of low filtration rates caused by the high viscosity of the oil/solvent/wax slurry feed to the filter. The high viscosity of the feed to the filter is due to a low supply of available solvent to be injected into the feed stream to the filter. In some cases, lack of sufficient solvent can result in poor wax crystallization and ultimately lower lube oil recovery.

The use of solvents to facilitate wax removal from lubricants is energy intensive due to the requirement for separating from the dewaxed oil and recovery of the expensive solvents for recycle in the dewaxing process.

The solvent is conventionally separated from the dewaxed oil by the addition of heat, followed by a combination of multistage flash and distillation operations. The separated solvent vapors must then be cooled and condensed and further cooled to the dewaxing temperature prior to recycle to the process.

Membrane separation of solvent from the filtrate is a promising process, if suitably selective membranes can be found and operated a low temperature to achieve thermodynamic efficiencies. Such membranes are found in U.S. Pat. Nos. 5,264,166 (White et al) and 5,360,530 (Gould et al); and the present invention relates to improved operation of selectively permeable membranes. These membranes are found to have a high permeability for solvent at low temperature, while rejecting oil, and are suitable for use in solvent recovery from the oil/solvent filtrate mixture.

It has been discovered that the membrane separation can be improved by solvent washing of the membrane under pressurized process conditions.

SUMMARY OF THE INVENTION

A process has been found for solvent dewaxing a waxy petroleum oil feed to obtain petroleum oil lubricating stock with improved performance. Waxy oil feed is treated with cold solvent to crystallize and precipitate wax particles, thereby forming a multiphase oil/solvent/wax mixture containing filterable wax particles, and the multiphase mixture is filtered to remove filterable wax particles from the cold oil/solvent/wax mixture to recover a cold wax cake and a cold oil/solvent filtrate stream.

The improvement herein comprises: feeding the cold oil/solvent filtrate stream containing wax particles under pressure (e.g.—at least 2750 kPa) to a selective permeable membrane for selectively separating the cold filtrate into a cold solvent permeate stream and a cold oil-rich retentate stream which contains the dewaxed oil and the remaining solvent; periodically interrupting flow of the filtrate stream to the membrane; and directing a warm stream of recovered solvent at process pressure onto the membrane surface to wash the membrane and remove impurities therefrom.

DETAILED DESCRIPTION OF THE INVENTION

Figure 1:
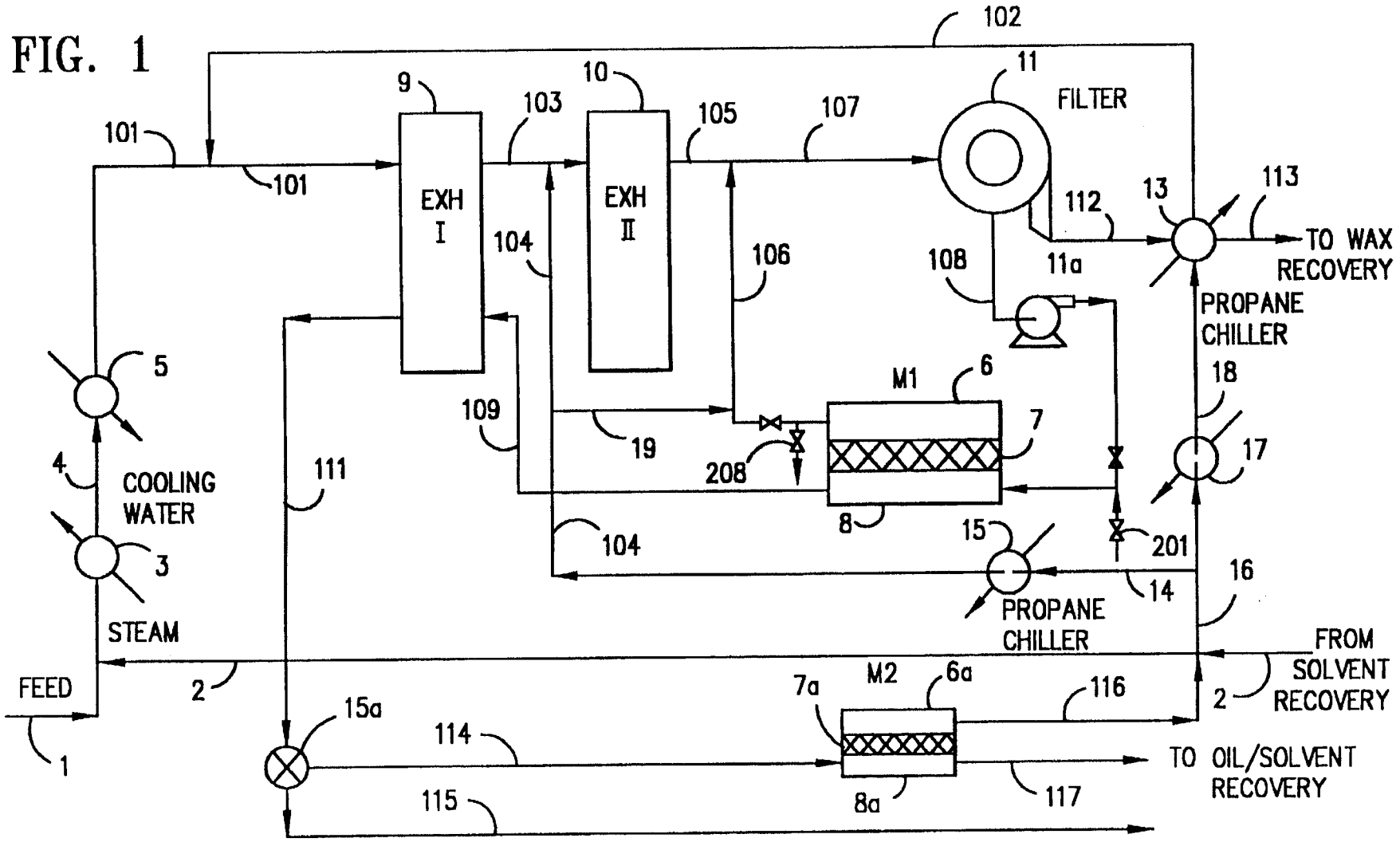
FIG. 1 is a schematic process flow sheet depicting the invention generally.

The following description of the process of the present invention is given with reference a preferred embodiment of the invention as depicted in the drawing. Metric units and parts by weight are employed unless otherwise indicated.

In FIG. 1, a waxy oil feed, after removal of aromatic compounds by conventional phenol or furfural extraction, is introduced through line 1 at a temperature of 55° to 95° C. (about 130° to 200° F.) and is mixed with MEK/toluene solvent fed through line 2 at a temperature of 35°–60° C. (95°60 to 140° F.) from the solvent recovery section, not shown. The solvent is added at a volume ratio of 0.5 to 3.0 solvent per part of waxy oil feed. The waxy/oil solvent mixture is fed to heat exchanger 3 and heated by indirect heat exchange to a temperature above the cloud point of the mixture of about 60°–100° C. (140° to 212° F.) to insure that all wax crystals are dissolved and in true solution. The warm oil/solvent mixture is then fed through line 4 to heat exchanger 5 in which it is cooled to a temperature of 35°–85° C. (about 95° to 185° F.).

The waxy oil feed in line 101 is then mixed directly with solvent at a temperature of 5°–60° C. (40° to 140° F.) fed through line 102 to cool the feed to a temperature of 5°–60° C. (40° to 140° F.), depending on the viscosity, grade and wax content of the waxy oil feed. The solvent is added to the waxy oil feed through line 102 in an amount of 0.5 to 2.0 parts by volume per part of waxy oil in the feed. The temperature and solvent content of the cooled waxy oil feed stream in line 101 is controlled at a few degrees above the cloud point of the oil feed/solvent mixture to preclude premature wax precipitation. A typical target temperature for the feed in line 101 would be 5°–60° C. (40°–140° F.).

The cooled waxy oil feed and solvent are fed through line 101 to scraped-surface double pipe heat exchanger 9.

The cooled waxy oil feed is further cooled by indirect heat exchange in heat exchanger 9 against cold filtrate fed to the heat exchanger 9 through line 109. It is in heat exchanger 9 that wax precipitation typically first occurs. The cooled waxy oil feed is withdrawn from exchanger 9 by line 103 and is injected directly with additional cold solvent feed through line 104. The cold solvent is injected through line 104 into line 103 in an amount of 0 to 1.5, e.g. 0.1 to 1.5, parts by volume based on one part of waxy oil feed. The waxy oil feed is then fed through line 103 to direct heat exchanger 10 and is further cooled against vaporizing propane in scraped-surface, double pipe heat exchanger 10 in which additional wax is crystallized from solution. The cooled waxy oil feed is then fed through line 105 and mixed with additional cold solvent injected directly through line 106. The cold solvent is fed through line 106 in an amount of 0.1 to 3.0, e.g. 0.5 to 1.5, parts by volume per part of waxy oil feed. The final injection of cold solvent at or near the filter feed temperature through line 106 serves to adjust the solids content of the oil/solvent/wax mixture feed to the main filter 11 at a rate of 3–10 volume percent, in order to facilitate filtration and removal of the wax from the waxy oil/solvent/wax mixture feed to the main filter 11. The mixture is then fed through line 107 to the main filter 11 and the wax is removed. The temperature at which the oil/solvent/wax mixture is fed to the filter is the dewaxing temperature and can be (−10° to +20° F.) −23° to −7° C. and determines the pour point of the dewaxed oil product.

If desired, a slipstream 19 from line 104 can be combined with the solvent in line 106 to adjust the solvent temperature prior to injecting the solvent in line 106 into line 107. The remaining solvent in line 104 is injected into line 103 to adjust the solvent dilution and viscosity of the oil/solvent/wax mixture feed prior to feeding the mixture through line 103 to the exchanger 10. The oil/solvent/wax mixture in line 107 is then fed to rotary vacuum drum filter 11 in which the wax is separated from the oil and solvent.

One or more main filters 11 can be used and they can be arranged in parallel or in a parallel/series combination. A separated wax is removed from the filter through line 112 and is fed to indirect heat exchanger 13 to cool solvent recycled from the solvent recovery operation. The cold filtrate is removed from filter 11 through line 108 and at this point contains a solvent to oil ratio of 15:1 to 2:1 parts by volume and is at a typical temperature of −23° to +6° C. (−10° to +50° F.).

The cold filtrate in line 108 is increased in pressure by pump 11A and fed to selective permeable membrane module M1 at the filtration temperature. The membrane module M1 contains a low pressure solvent permeate side 6 and a high pressure oil/solvent filtrate side 8 with the selective permeable membrane 7 in between.

The cold oil/solvent filtrate at the filtration temperature is fed through line 108 to the membrane module M1. The membrane 7 allows the cold MEK/tol solvent from the oil/solvent filtrate side 8 to selectively permeate through the membrane 7 into the low pressure permeate side 6 of the membrane module. The cold solvent permeate is recycled directly to the filter feed line 107 at the filter feed temperature. The solvent selectively permeates through the membrane 7 in an amount of 0.1 to 3.0 parts by volume per part of waxy oil in the feed.

About 10 to 100%, typically 20 to 75% and more typically 25 to 50% by volume of the MEK/tol. solvent in the cold filtrate permeates through the membrane and is recycled to the filter feed line 107. The removal of cold solvent from the filtrate and the recycle of the removed solvent to the filter feed reduces the amount of solvent needed to be recovered from the oil/solvent filtrate and reduces the amount of heat required to subsequently heat and distill the solvent from the filtrate in the solvent recovery operation, respectively. Higher oil filtration rates and lower oil-in wax contents are obtained as a result.

The filtrate side of the membrane is maintained at a positive pressure of 1500–7400 kPa (about 200–1000 psig) and preferably 2750–5500 kPa (400–800 psig) greater than the pressure of the solvent permeate side of the membrane to facilitate the transport of solvent from the oil/solvent filtrate side of the membrane to the solvent permeate side of the membrane. The solvent permeate side of the membrane is typically at 100–4000 kPa (0–600 psig, preferably 5–50 psig, for example at about 25 psig).

The membrane 7 has a large surface area which allows very efficient selective solvent transfer through the membrane. The cold filtrate removed from the membrane module M1 is fed through line 109 to indirect heat exchanger 9, in which it is used to indirectly cool warm waxy oil feed fed through line 101 to the heat exchanger 9. The amount of solvent to be removed by the membrane module M1 is determined, to some extent, by the feed pre-cooling requirements. The cold filtrate is then fed through line 111 to line 115 and sent to an oil/solvent separation operation in which the remaining solvent is removed from the dewaxed oil.

The solvent is separated from the oil/solvent filtrate in the oil/solvent recovery operation, not shown, by heating and removing the solvent by distillation. The separated solvent is recovered warm and returned through line 2 to the dewaxing process. The wax and solvent free oil product is recovered and used as lubricating oil stock.

A portion of the solvent from the solvent recovery operation is fed through line 2 at a temperature of about 35°–60° C. (95° to 140° F.) to be mixed with waxy oil feed fed through line 1. Another portion of the recovered solvent is fed through line 2 to line 16 and into heat exchangers 17 and 13 in which the solvent is cooled to about the dewaxing temperature by indirect heat exchange against cooling water and wax/solvent mixture, respectively. Another portion of the recovered solvent is fed through lines 2, 16 and 14 to heat exchanger 15 in which it is cooled by indirect heat exchange with cold refrigerant, e.g. vaporizing propane, to about the fluid temperature in line 103 and fed through line 104 and injected into the oil/solvent/wax mixture in line 103.

In an alternative embodiment of the present invention the filtrate stream in line 111 can be fed through valve 15*a* and line 114 to membrane module M2. The filtrate is fed to module M2 at a temperature of 15° to 50° C. and solvent is selectively transferred through the membrane 7*a* and is fed through line 116 and recycled to the dewaxing process. The membrane module M2 is operated in the same manner as membrane module M1, except for the temperature of separation, and can contain the same membrane as module M1.

The use of the membrane module M2 embodiment allows reducing cooling capacity requirements and reducing utility consumption in the solvent/oil recovery section. However, since the recovered solvent permeate is at a higher temperature than the solvent recovered from module M1 the solvent from the membrane module M2 must be cooled prior to being used in the dewaxing process, as for example in heat exchangers 15 or 17 and 13. The higher temperature, however, allows more solvent to be recovered because of the higher permeate rate of the higher temperature as compared to M1.

Membranes

In the present invention, a membrane module comprised of either hollow fibers or spiral wound or flat sheets may used to selectively remove cold solvent from the filtrate for recycle to the filter feed. For the solvent-oil separation of the present invention, the membrane materials that can be used include, but are not limited to isotropic or anisotropic materials constructed from polyethylene, polypropylene, cellulose acetate, polystyrene, silicone rubber, polytetrafluoroethylene, polyimides, or polysilanes. Asymmetric membranes may be prepared by casting a polymer film solution onto a porous polymer backing, followed by solvent evaporation to provide a permselective skin and coagulation/washing.

In the preferred embodiments, a polyimide membrane is cast from the polymer based on 5(6)-amino-1-(4'-aminophenyl)- 1,3,3 trimethylindane (commercially available as "Matrimid 5218"). The membrane is configured as spiral wound module, which is preferred due to its balance between high surface area, resistance to fouling, and facility for cleaning.

Membrane Cleaning Procedure—Over time the membrane modules will foul and performance will degrade due to the accumulation of wax particles within the feed channel. Wax particles are naturally contained in the filtrate feed in an amount dependent upon the condition of the canvasses on the MEK Dewaxing Unit rotary filters. Typical wax loadings range from 10–300 ppm vol for a well maintained filter canvas. Even a small tear in a filter canvas can result in filtrate wax loadings on the order of 1–2 vol %.

Figure 3:
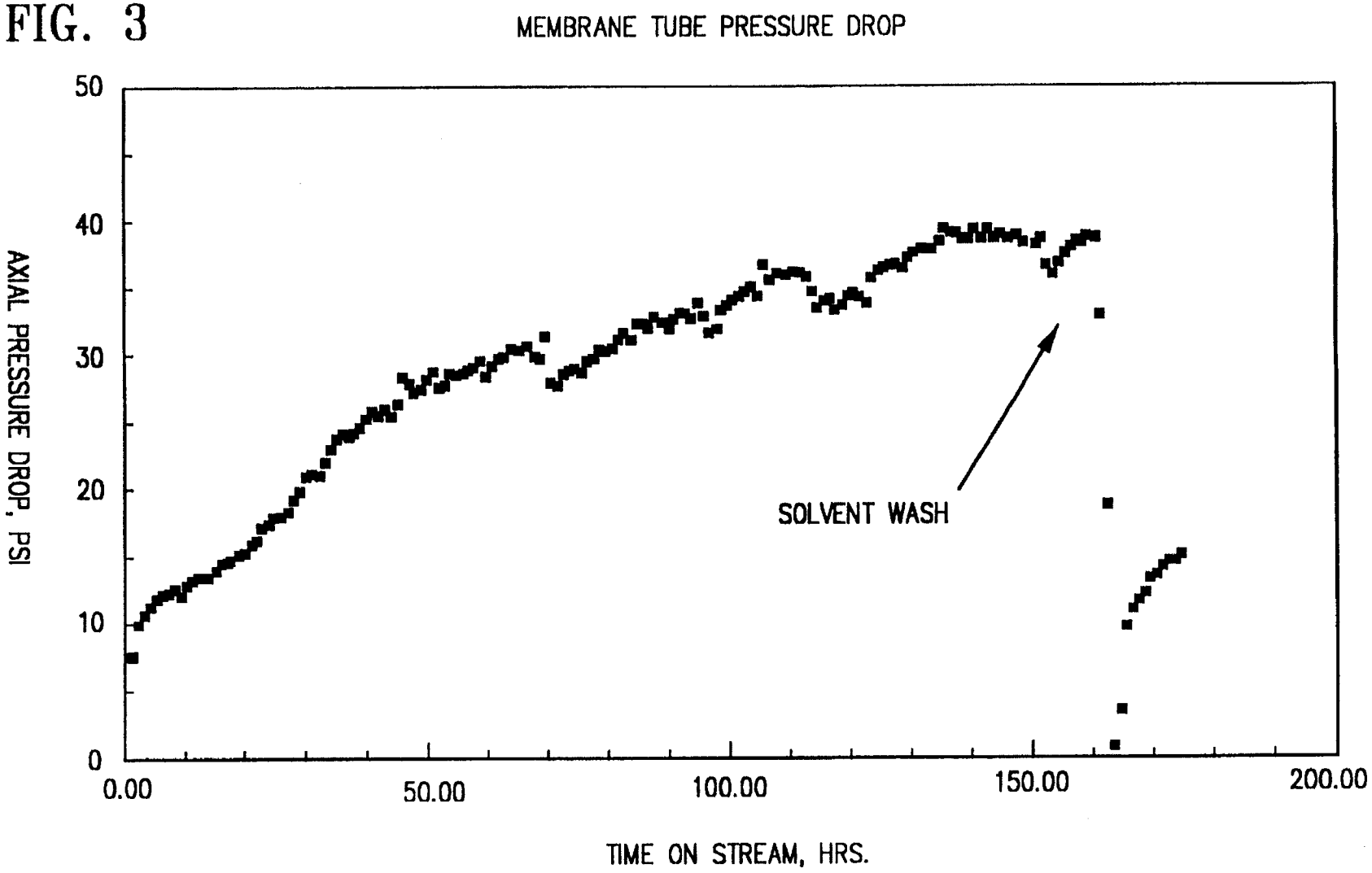
FIG. 3. is a graphic plot of pressure drop vs. operating time on stream for a typical tubular membrane unit.
Figure 4:
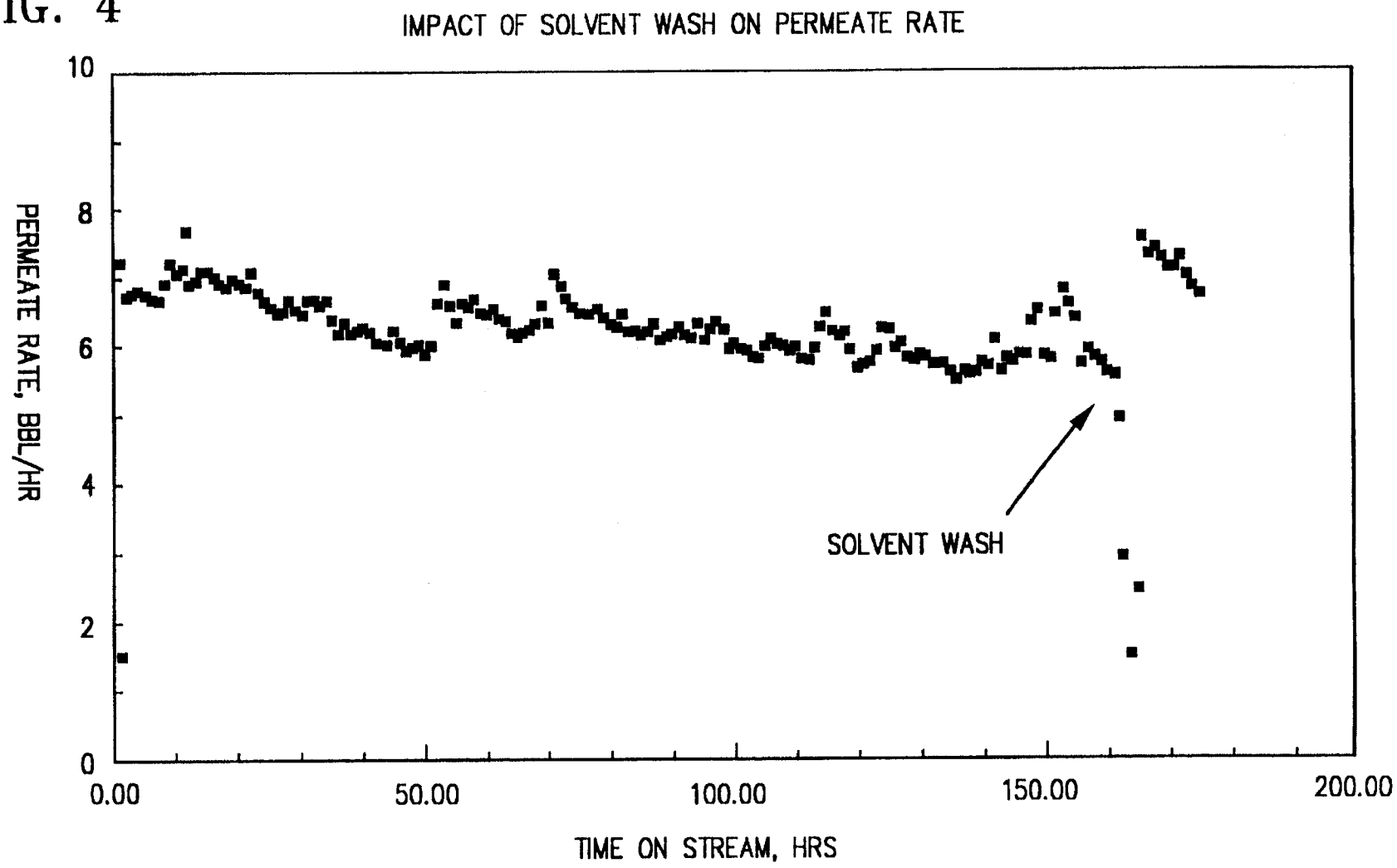
FIG. 4 is a similar graphic plot depicting permeate flow rate vs. operating time on stream before and after solvent washing.

Deposition of the wax within the feed channels of the module tends to increase axial pressure drop at constant feed rate as the cross-sectional area available for fluid flow decreases. The rate of pressure drop increase for an 8-inch diameter×40-inch long spiral wound module processing a lube oil filtrate stream containing about 75 ppm vol of 25 micron diameter and smaller wax particles is shown in FIG. 3. Wax lay-down on the membrane surface also results in a 30% decrease in solvent permeation rates as shown in FIG. 4. Both FIGS. 3 and 4 show that a 30 minute wash with clean solvent at a temperature of 40° F. (4.5° C.) restores membrane performance to baseline values.

Figure 2:
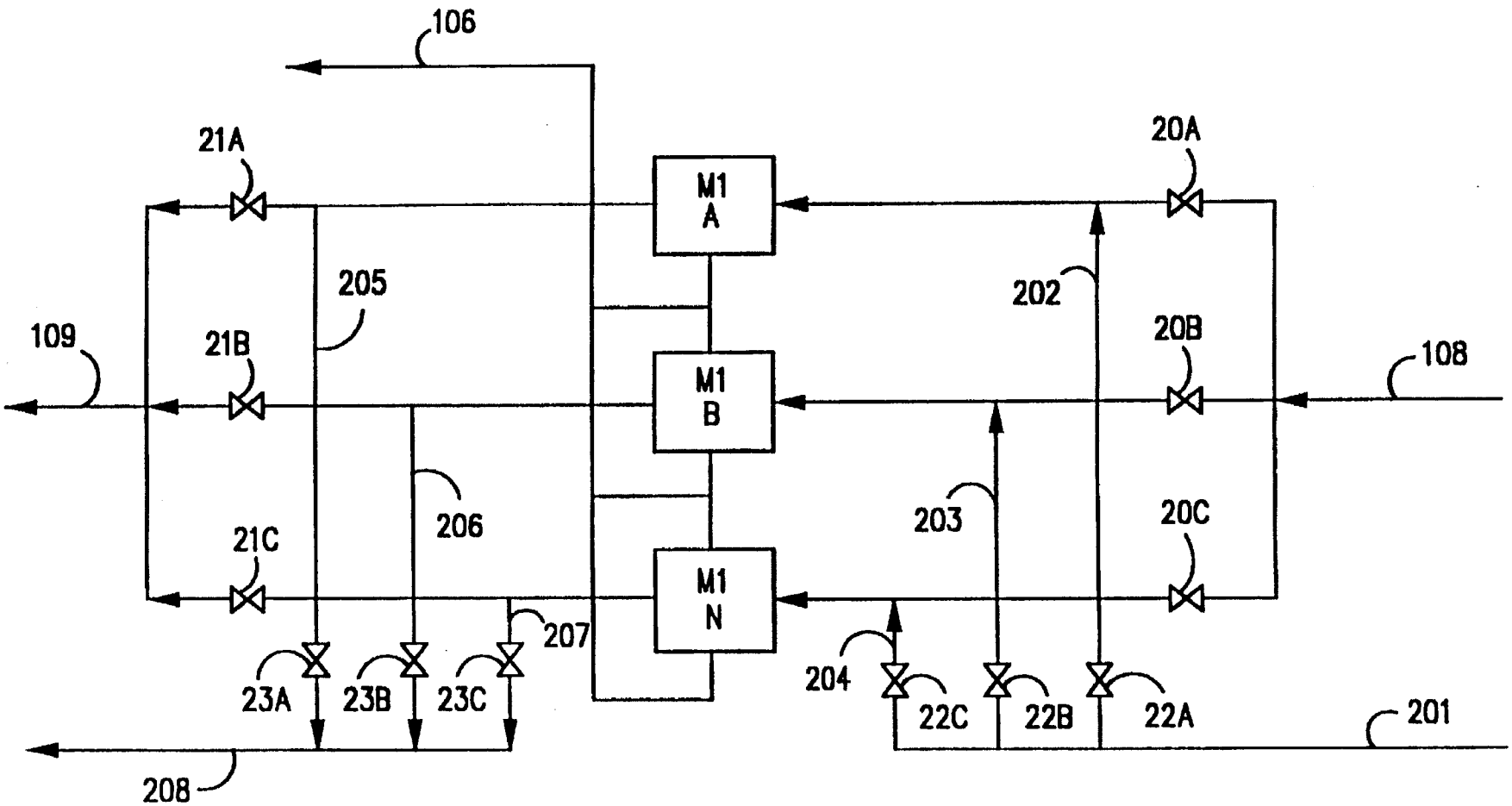
FIG. 2 is a process schematic showing details of the solvent wash lines and valving according to the present invention.

A schematic of the equipment required for solvent washing of a fouled membrane is shown in FIG. 2. In this process flow diagram, the M1 membrane unit from FIG. 1 is depicted as a multiplicity of membrane units operating in parallel. Membrane Units M1-A, M1-B, through M1-N may represent either a single membrane module or an entire bank of membrane tubes containing several modules each. Under normal operation, lube oil filtrate is fed to the collective membrane unit M1 via line 108. The feed is further subdivided in a feed manifold to supply an individual feed stream to membrane units M1-A, M1-B, through M1-N. The feeds are separated into a collective permeate stream 106 and a combined retentate stream 109.

When it is desired to clean membrane unit M1-A, valves 20A and 21A are closed to isolate the membrane to be washed from the operating system. Warm, clean solvent is then fed to M1-A via lines 201 and 202 by opening valves 22A and 23A. The temperature of the wash solvent can be anywhere between the filtrate feed temperature and the maximum stable temperature of the membrane. The pressure of the wash solvent is not critical, but may vary up to the process pressure of 1500–7400 kPa. Low wash temperatures require the longest wash times, but afford maximum protection of the membrane from high-temperature damage. For this system, the preferred wash solvent temperature range of 40°–70° F. (4.5–°21° C.) represents an acceptable balance between wash time and membrane protection. The wash solvent flow rate is not critical and is selected to balance wash time requirements and wash solvent pump capacity. The warm solvent sweeps through M1-A, dissolving the wax deposits. The wash solvent and dissolved wax is returned to the dewaxing process via line 205 and slop header 208. Membrane unit M1-A is returned to service by closing valves 22A and 24A, then opening valves 20A and 21A.

Membrane units M1-B through M1-N can be cleaned in an analogous manner using the valving and wash/slop lines shown in FIG. 2. Manifolding the wash system in the manner shown makes it possible to clean a selected portion of the total membrane unit while continuing normal operation of the balance of the membranes. It is not necessary to segregate the normal permeate from the solvent which is expected to permeate during a wash cycle, although valving may be added for this purpose as needed to maintain the desired temperature and purity of stream 106. In a preferred embodiment, the permeable membrane system comprises parallel banks of spirally wound membrane modules, and individual module banks may be washed while other banks remain on stream.

The periodic washing step may be effected for a time period of 15 to 60 minutes following wax buildup during continuous membrane operation. The washing frequency is dictated by wax load on the membranes and will vary according to process conditions. A typical periodic washing step is conducted at solvent wash flow rate of 0.001 to 0.03 kg/min of solvent per square meter of membrane area, preferably less than 0.004 kg/min/$m^2$.

We claim:

1. A semicontinuous process for solvent dewaxing a waxy petroleum oil feed stream comprising the steps of:

diluting of the waxy oil feed stream with solvent;

cooling the waxy oil feed stream in successive heat exchange stages;

feeding the oil/solvent/wax mixture to a filter to remove the wax and obtain an oil/solvent filtrate stream, contacting the oil/solvent filtrate stream at a temperature of −35° C. to +20° C. with one side of a selective semipermeable membrane in a membrane module to selectively transfer solvent through the membrane to obtain a solvent permeate stream on the other side of the membrane, the oil/solvent filtrate stream side of the membrane is maintained at a positive pressure relative to a pressure on the solvent permeate side of the membrane, and wherein the volume ratio of solvent in the permeate stream to retentate stream is 1:1 to 3:1;

selectively transferring a major amount of solvent from the filtrate side of the membrane to the solvent permeate side of the membrane, and recycling the solvent permeate at a temperature of −35° C. to +20° C. to the filter feed;

withdrawing a solvent-lean filtrate stream containing the remaining solvent from the filtrate side of the membrane module, contacting the filtrate stream by indirect heat exchange with the warm waxy oil feed;

treating the withdrawn filtrate stream to recover the remaining solvent from the oil;

recovering a dewaxed oil product stream and a wax product; and periodically directing a warm stream of recovered solvent onto the membrane surface to wash the membrane and remove impurities therefrom.

2. The process of claim 1 wherein the dewaxing solvent comprises a mixture of methyl ethyl ketone and toluene (MEK/tol.) and the ratio of MEK:tol. is 60:40 to 80:20 parts by weight.

3. The process of claim 1 wherein the waxy oil feed is a heavy neutral lubricating oil stock having a boiling range of 454° C. to 566° C.

4. The process of claim 1 wherein the waxy oil feed is a deasphalted lubricating oil stock having a boiling range of 566° to 704° C.

5. The process of claim 1 wherein the warm stream of recovered solvent is directed onto the membrane surface at a process pressure of at least 2750 kPa.

6. The process of claim 1 wherein the temperature of the warm stream of recovered solvent is from 4.5° to 21° C.

7. In the process for solvent dewaxing a waxy petroleum oil feed to obtain petroleum oil lubricating stock wherein waxy oil feed is treated with cold solvent to crystallize and precipitate wax particles, thereby forming a multiphase oil/solvent/wax mixture containing filterable wax particles, and wherein the multiphase mixture is filtered to remove filterable wax particles from the cold oil/solvent/wax mixture to recover a cold wax cake and a cold oil/solvent filtrate stream; the improvement which comprises: feeding the cold oil/solvent filtrate stream containing wax particles under operating pressure of at least 2750 kPa to a selective permeable membrane for selectively separating the cold filtrate into a cold solvent permeate stream and a cold oil-rich retentate stream which contains the dewaxed oil and the remaining solvent; and periodically interrupting flow of the filtrate stream to the membrane; and directing a warm stream of recovered solvent onto the membrane surface to wash the membrane and remove impurities therefrom.

8. The process of claim 7 wherein the membrane consists essentially of the polyimide polymer based on 5(6)-amino-1-(4'-aminophenyl)-1,3,3 trimethylindane.

9. The process of claim 7 wherein the cold oil-rich retentate stream contains dewaxed oil and solvent is distilled to recover dewaxed oil product and to recover the warm solvent stream for washing.

10. The process of claim 7 wherein the dewaxing solvent comprises MEK and toluene in ratio of 60:40 to 80:20 parts by weight and wherein the warm solvent stream is recovered at a temperature of 10° C. to 50° C.

11. The process of claim 10 wherein periodic washing step is effected for a time period of 15 to 60 minutes following wax buildup during continuous membrane operation.

12. The process of claim 7 wherein periodic washing step is conducted at a solvent wash flow rate of 0.001 to 0.03 kg/min of solvent per square meter of membrane area.

13. The process of claim 7 wherein the permeable membrane comprises parallel banks of spirally wound membrane modules, and wherein individual module banks are washed while other banks remain on stream.

14. The process of claim 7 wherein the warm stream of recovered solvent is directed onto the membrane surface at a process pressure of at least 2750 kPa.

15. The process of claim 5 wherein the temperature of the warm stream of recovered solvent is from 4.5° to 21° C.

* * * * *